US011613994B2

(12) United States Patent
Bowen

(10) Patent No.: US 11,613,994 B2
(45) Date of Patent: Mar. 28, 2023

(54) PISTON ARRANGEMENT

(71) Applicant: NEWLENOIR LIMITED, London Middlesex (GB)

(72) Inventor: Ryan Bowen, London Middlesex (GB)

(73) Assignee: NEWLENOIR LIMITED, London (GB)

( * ) Notice: Subject to any disclaimer, the term of this patent is extended or adjusted under 35 U.S.C. 154(b) by 0 days.

(21) Appl. No.: 17/437,830

(22) PCT Filed: Feb. 24, 2020

(86) PCT No.: PCT/GB2020/050434
§ 371 (c)(1),
(2) Date: Sep. 9, 2021

(87) PCT Pub. No.: WO2020/183127
PCT Pub. Date: Sep. 17, 2020

(65) Prior Publication Data

US 2022/0154579 A1 May 19, 2022

(30) Foreign Application Priority Data

Mar. 11, 2019 (GB) ..... 1903301

(51) Int. Cl.
*F01B 9/04* (2006.01)
*F01B 9/06* (2006.01)

(52) U.S. Cl.
CPC ..... *F01B 9/042* (2013.01); *F01B 9/047* (2013.01); *F01B 9/06* (2013.01)

(58) Field of Classification Search
CPC ..... F01B 9/042; F01B 9/047; F01B 9/06
See application file for complete search history.

(56) References Cited

U.S. PATENT DOCUMENTS 1,597,474 A 8/1926 Nordwick
3,274,982 A 9/1966 Masaaki Noguchi et al.
(Continued)

FOREIGN PATENT DOCUMENTS

BE 438224 A 4/1940
DE 102011121134 A1 6/2013
(Continued)

OTHER PUBLICATIONS

United Kingdom Application No. GB 1903301.8; Combined Search and Examination Report; Examiner: Mr. Kevin Hewitt; dated Aug. 19, 2019; 6 pgs.
(Continued)

*Primary Examiner* — Jacob M Amick
*Assistant Examiner* — Charles J Brauch
(74) *Attorney, Agent, or Firm* — Tarolli, Sundheim, Covell & Tummino LLP

(57) ABSTRACT

A piston arrangement comprising: a piston; a rotatable element, rotatable about an axis, having a first engagement profile; and a mechanism comprising: a first connecting element connected to the piston; a second connecting element pivotable about a fixed point and pivotally connected to the first connecting element; and a second engagement profile coupled to the first and/or second connecting element, configured to mechanically engage and disengage with the first engagement profile of the rotatable element.

20 Claims, 7 Drawing Sheets

(56) References Cited

U.S. PATENT DOCUMENTS

| | | | | |
|---|---|---|---|---|
| 3,964,450 | A | 6/1976 | Lockshaw | |
| 3,998,200 | A | 12/1976 | Sudholt | |
| 6,422,196 | B1 | 7/2002 | Pien | |
| 2016/0214644 | A1 * | 7/2016 | Cmich | B62D 7/08 |

FOREIGN PATENT DOCUMENTS

| | | | | |
|---|---|---|---|---|
| EP | 0658688 | A1 | 6/1995 | |
| FR | 2655378 | A1 | 6/1991 | |
| GB | 316696 | A | 8/1929 | |
| WO | 2001/42624 | A2 | 6/2001 | |
| WO | WO-0142624 | A2 * | 6/2001 | F01B 13/045 |
| WO | 20120044185 | A1 | 4/2012 | |
| WO | WO-2015107330 | A2 * | 7/2015 | F01B 3/04 |

OTHER PUBLICATIONS

Applicant: Newlenoir Limited; "A Piston Arrangement"; PCT International Appl. No. PCT/GB2020/050434; filed Feb. 24, 2020; PCT International Search Report and Written Opinion; Authorized Officer: Bo Paulson, dated May 19, 2020; 13 pgs.

United Kingdom Application No. GB1903301.8; Search Report; Examiner: Mr. Kevin Hewitt; dated Oct. 29, 2019 2 pgs.

* cited by examiner

PISTON ARRANGEMENT

CROSS-REFERENCE TO RELATED APPLICATION

This patent application is a U.S. National Stage Application filed under 35 U.S.C. § 371 of PCT/GB2020/050434, filed Feb. 24, 2020, and entitled A PISTON ARRANGEMENT, which International Application claims the benefit of priority from United Kingdom Patent Application No. GB 1903301.8, filed on Mar. 11, 2019. The entire contents of each of the above-identified patent applications are incorporated herein by reference.

FIELD OF THE INVENTION

The present invention relates to a piston arrangement and an internal combustion engine incorporating such an arrangement.

BACKGROUND OF THE INVENTION

Most engines that use an expansion of a fluid to drive a piston convert the reciprocating motion of the piston into rotating motion by way of a crank shaft coupled to the piston via a connecting rod. An alternative arrangement for transferring power from a piston to a rotating shaft is disclosed WO 2015/107330 A2, in which a piston is coupled to a track by a follower. However, improved power transmission from a piston to a rotating shaft is possible.

SUMMARY OF THE INVENTION

According to an aspect of the invention, there is provided a piston arrangement as defined in claim 1.

With such an arrangement, the piston and the rotatable element can be coupled for a greater portion of the drive stroke of the piston, meaning that a greater proportion of the power from the piston can be transferred to the rotatable element. Overall, this can lead to a greater efficiency of power transfer.

The second engagement profile can include a plurality of second teeth. Such an arrangement can lead to reduced wear on the second engagement profile.

At least two of the teeth can have different sizes. With such an arrangement, the surfaces can be configured so that each engages with the second engagement profile at an optimal angle.

Similarly, the first engagement profile can include a plurality of first teeth. The plurality of second teeth can allow reduced wear on each tooth.

The first and second engagement profiles can form a rack and sector gear arrangement.

When the first and second engagement profiles engage, the engagement can be at a point between the fixed point and the axis of rotation of the rotatable element. Such an arrangement can allow the second connecting element to be in compression so as to keep the two engagement profiles engaged more reliably.

When the first and the second engagement profiles engage, the second connecting member can rotate in a first angular direction about the fixed point and the rotatable element can rotate in a second angular direction about the axis, with the first angular direction being opposite to the second angular direction. With such an arrangement, the two engagement profiles can move in arcs, which engage only at the required point in the piston cycle, so that improved engagement of the two profiles can be achieved.

The piston arrangement can further comprise a track arranged to rotate about a track axis, the piston being coupled to the track, wherein the track and the rotatable element are coupled in rotation. With such an arrangement, the track provides a more customisable way to move the piston during strokes other than the drive stroke.

The piston can be coupled to the track via a follower coupled to the first and/or second connecting element, the follower being arranged to run along a surface of the track. Using the first connecting element to couple the track to the piston means that a specific extra member for coupling the piston to the track is not necessary and hence, such an arrangement can provide a weight saving.

The follower may be arranged to be coupled to the first and second connecting element at the pivot joint between the first and second connecting element. Alternatively, the follower may be connected to the second connecting element at a point away from the pivot connection between the first and the second connecting element.

The piston arrangement can further comprise a further plurality of followers, each follower being arranged to run along a surface of the track, and/or a plurality of concentric tracks. Providing a plurality of followers and a plurality of tracks can allow the wear on each track and each follower to be reduced.

The piston arrangement may have a single follower which is disposed between a radially outer track and a radially inner track or may have a single track with a radially outer and radially inner surface, and two or more followers where at least one follower runs along each surface of the track.

The tracks can be formed as elongate protrusions from a plate, the plate being substantially planar in a plane normal to the track axis. Thus, the tracks can be formed in a resilient way. Alternatively, the track may be formed as a channel recessed into a plate.

The track can be shaped such that the movement of the piston coupled to the track is substantially non-simple harmonic. This can allow the movement of the piston to be more customizable.

The piston can reciprocate twice for each rotation of the rotatable element. This can allow the piston arrangement to be used in a four stroke engine.

The piston can be a first piston and the piston arrangement can further comprise a second piston movable within a respective cylinder, a further first connecting element connected to the second piston, and a further second connecting element pivotable about a second fixed point, wherein the rotatable element is configured to mechanically engage and disengage with each of the first connecting elements.

The second piston and the first piston can be arranged in an opposing relationship. With such arrangement, a balanced piston arrangement can be formed.

According to a second aspect of the invention, there is provided an internal combustion engine comprising a piston arrangement according to the first aspect.

According to a third aspect of the invention, there is provided a piston arrangement comprising: a piston; a rotatable element comprising a track, rotatable about an axis, a mechanism comprising: a first connecting element connected to the piston; a second connecting element pivotable about a fixed point and pivotally connected to the first connecting element; and a first follower arranged to follow the track, the follower coupled to the second connecting element.

In such an arrangement, the rotatable element of the piston arrangement may have no element which engages with and disengages from the connecting elements. Force transfer to the rotatable element can be made instead by a follower which is engaged with the track for the entirety of the rotation.

The third aspect of the invention may incorporate any features of the first aspect of the invention as required.

BRIEF DESCRIPTION OF THE DRAWINGS

Embodiments of the invention will now be described with reference to the accompanying drawings, in which.

DETAILED DESCRIPTION

Figure 1:
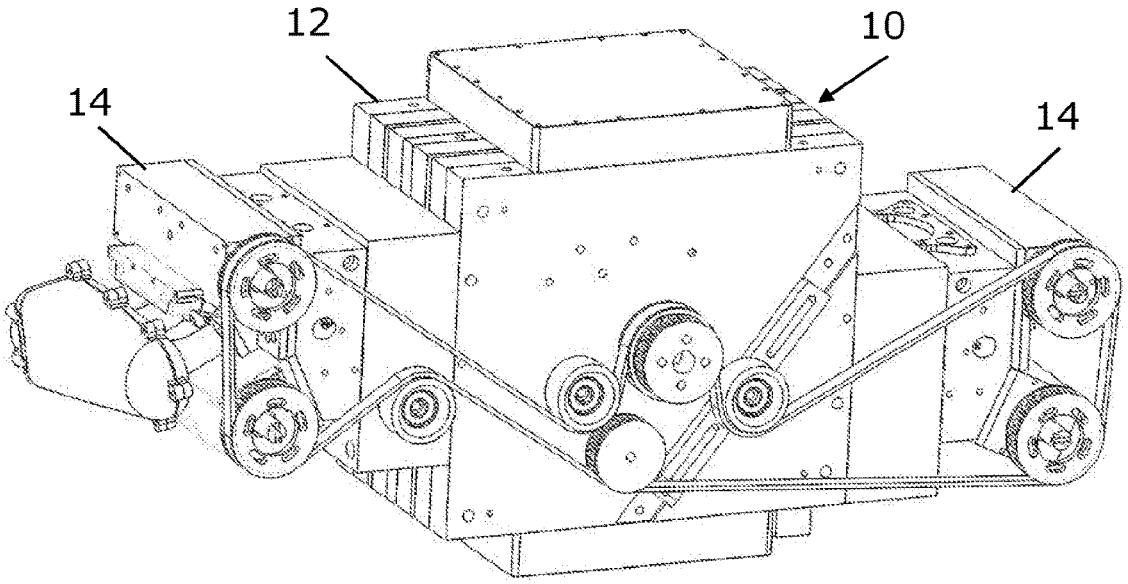
FIG. 1 shows an engine.

FIG. 1 shows an internal combustion engine 10 comprising a cylinder block assembly 12 and two head assemblies 14. The block assembly 12 comprises a plurality of casing members or plates, having different shapes such that a cylinder block 12 is formed when they are combined.

Figure 2:
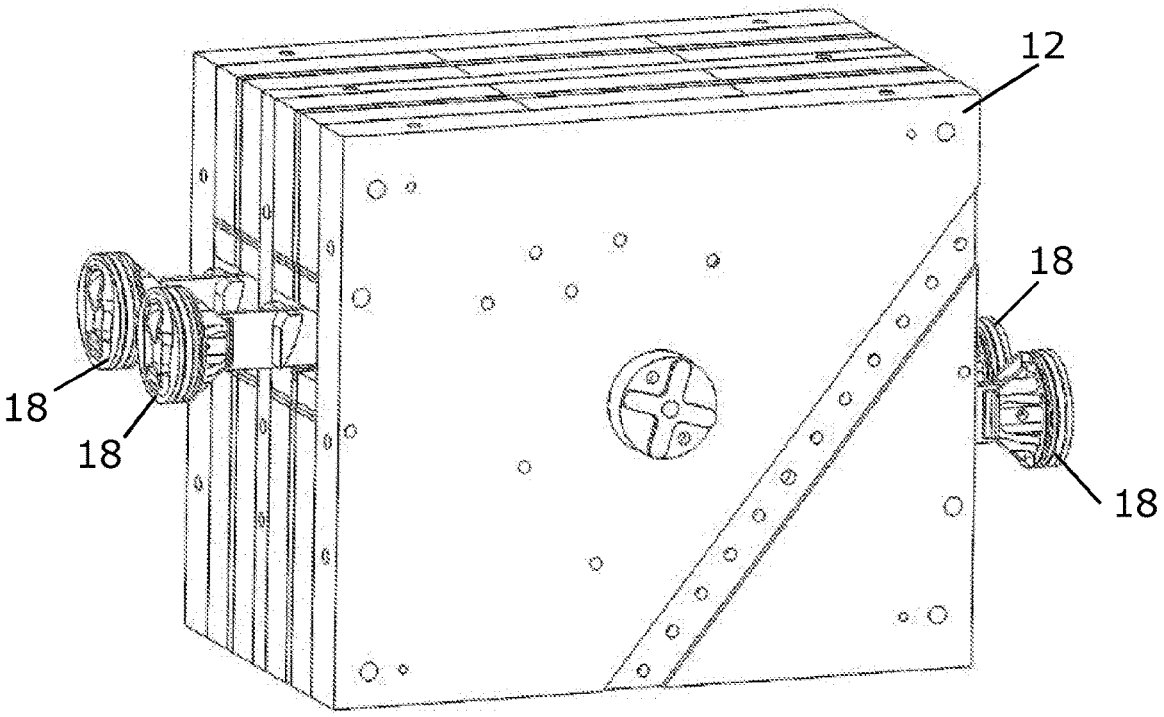
FIG. 2 shows the engine with various component's omitted.

FIG. 2 shows the engine 10 with the head assemblies 14 removed. The head assemblies contain cylinder bores, each receiving a respective cylinder liner, each cylinder liner receiving a respective piston. In this view, the pistons 18 can be seen protruding from the cylinder block 12. The engine 10 has a total of four pistons coupled in an opposed relationship to two tracks (not visible in FIG. 2). The engine 10 therefore includes four piston assemblies and the structure and functioning of the first piston assembly will be described in detail, although it will be appreciated that the second, third and fourth piston assemblies are structurally and functionally similar to the first piston assembly. While four pistons 18 are shown in FIG. 2, it will be understood that any other number of pistons may be used, for example two pistons or eight pistons.

Figure 3:
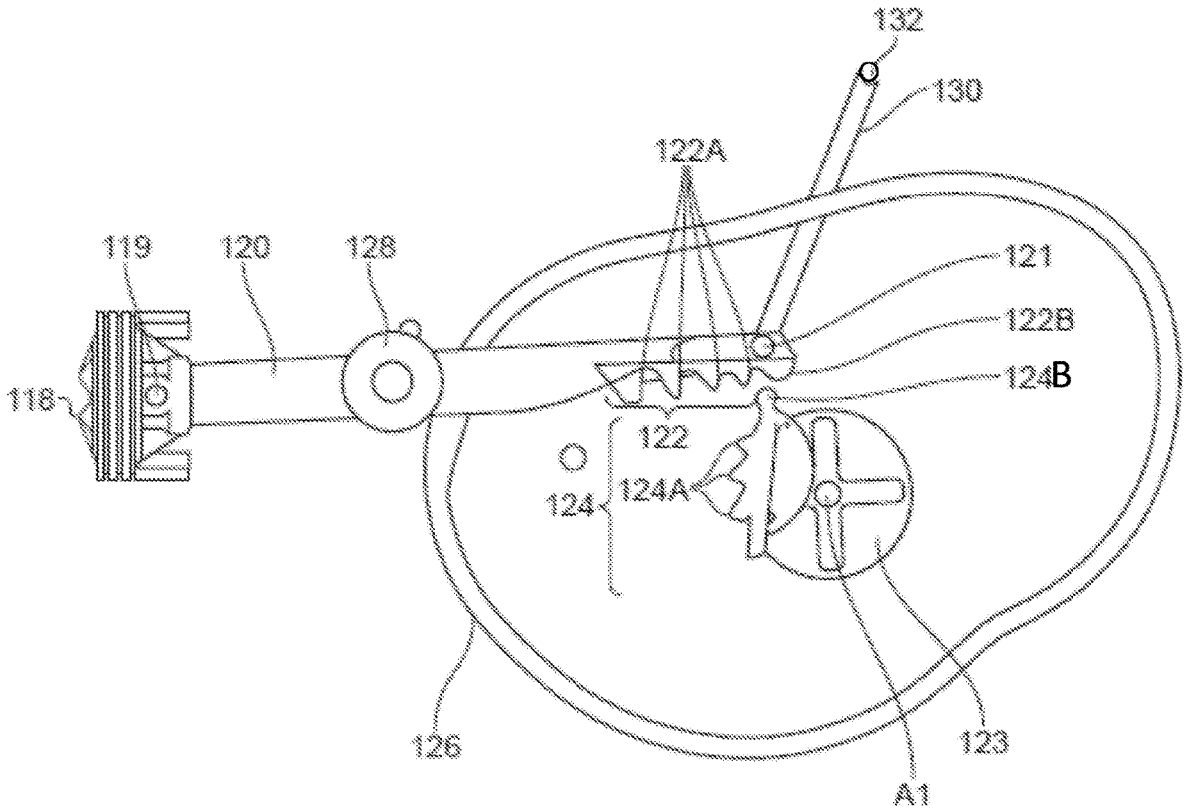
FIG. 3 shows a first piston arrangement.

FIG. 3 shows a piston arrangement according to the invention. In FIG. 3, there is shown a piston 118 that reciprocates within a cylinder. The piston 118 is coupled to a first connecting member 120 via a pivot pin 119. At the opposite end of the first connecting member 120, the elongate connecting member 120 is coupled to a second connecting member 130 by a second pivot pin 121. The second connecting member 130 is pivotally fixed at point 132 so as to form a mechanism with the first connecting member 120 and the piston 118.

Point 132 is fixed relative to the cylinder in which piston 118 reciprocates. It will be understood that the engine may move such as within a vehicle but that there will be no relative movement between point 132 and the cylinder.

The first connecting member 120 further comprises an engagement profile 122 for engaging with a second engagement profile 124, the second engagement profile 124 being coupled to a rotatable element 123, which is rotatable about an axis A1.

There is no relative movement between the point 132 and axis A1.

The first engagement profile 122 comprises multiple engagement surfaces 122A and a primary engagement surface 122B. As can be seen, the engagement surfaces 122A are separated by differing pitches and have differing sizes and inclinations with respect to the first connecting element 120. This variation in properties across the engagement profile allows the first and second engagement profiles 122 and 124 to remain engaged as the mechanism formed by the piston 118, first connecting member 120 and second connecting member 130 moves on a piston drive store. It can also be seen that the primary first engagement surface 122B is at an-end most point of the first connecting member 120 so that engagement and power transfer with the primary second engagement profile 124A can occur at an early stage within the drive or expansion stroke of the piston.

The rotatable element 123 comprises the second engagement profile 124, which comprises multiple second engagement surfaces 124A for engaging with the respective engagement surfaces 122A of the first engagement profile. The engagement profile 124 also comprises a second primary engagement surface 124B, which will engage with the primary engagement surface 122B of the first engagement profile. It can be seen that the second engagement profile 122 extends around approximately 25% of the circumference of the rotatable element 123.

While the engagement profiles shown each have multiple engagement surfaces, a single engagement surface on the first connecting member 120 and a single engagement surface on the rotatable element 123 may be sufficient to provide power transfer, such a single tooth and slot arrangement.

The piston arrangement also comprises a track 126 and a follower 128, configured to roll along the track 126. A sliding follower could also be used, which would slide along the track 126. The follower 128 is coupled to the first connecting member 120 and the action of the track 126 and follower 128 can move the piston in 118 in a return stroke and the track 126 can be shaped in any way so as to provide differing speeds for differing strokes of a cycle. For example, a substantially non-simple harmonic movement of the piston is possible through the track and follower arrangement.

Figure 4:
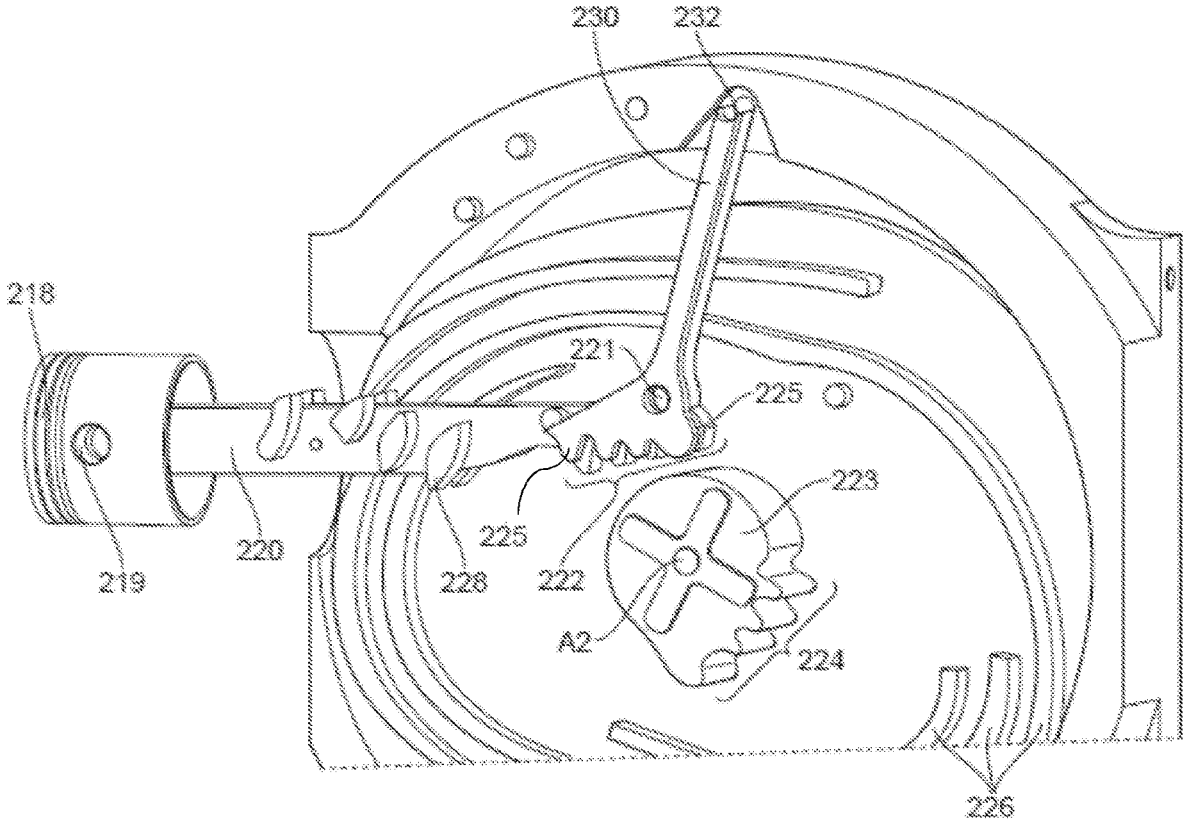
FIG. 4 shows a second piston arrangement.

FIG. 4 shows a further development on the piston arrangement shown in FIG. 3. In this arrangement, like parts are labelled with corresponding reference numerals and, for the sake of brevity, the descriptions of unchanged parts are not repeated here.

The rotatable element 223, which rotates about axis A2 has been made unitary with the engagement profile 224. However, the rotatable element 123 of FIG. 3 could equally be used in this context.

The second connecting element 230 has been modified so as to have a third engagement profile 225. The third engagement profile 225 lies substantially in line with the first engagement profile 222 at the point where both will engage with the first engagement profile 224. Thus, the force exerted on the rotatable element 223 can be spread across both the second and third engagement profiles 222, 225.

While the connection 219 is shown as being a pin joint, it is equally possible that the joint could be translatable in a direction perpendicular to the direction of movement of the piston while being non rotatable.

Figure 5:
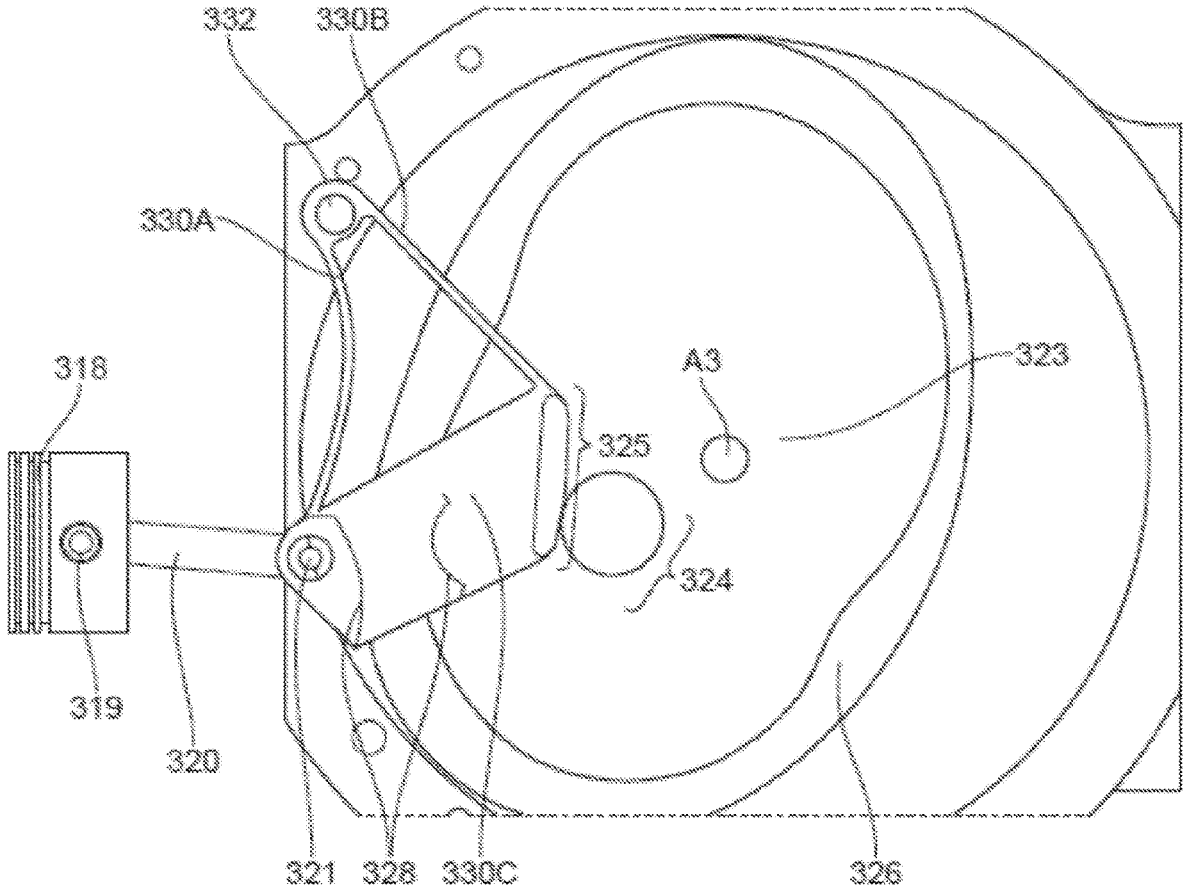
FIG. 5 shows a third piston arrangement.

Turning to FIG. 5, the arrangement shown in FIG. 4 has been adapted so that only the third engagement profile 325 engages with the rotatable element 323, which is rotatable about an axis A3. The second connecting member 330 is formed of three separate members. A first member 330*a* extends from the pivot point 332 to the pin joint for connecting to the first connecting member 320; the second member 330*b* extends between the pivot point 332 and the third engagement profile 325; and the third member 330*c* extends between the engagement profile 325 and the point join 321 between the first connecting member 320 and second connecting member 330. In order to reduce weight, there is a hollow space between the first, second and third members 330*a*, 330*b*, 330*c*. The pivot point 332 of the second connecting member 330 is separated from the piston by approximately 45°, the angle being measure at the axis A3. By moving the pivot point 332 closer to the piston 318, there is provided a greater lever arm at the point at which the drive stroke of the piston 318 begins.

As can be seen from FIG. 5, the first engagement portion 324 of the rotatable element 323 has been altered in order to engage with the third engagement portion 325.

Figure 6:
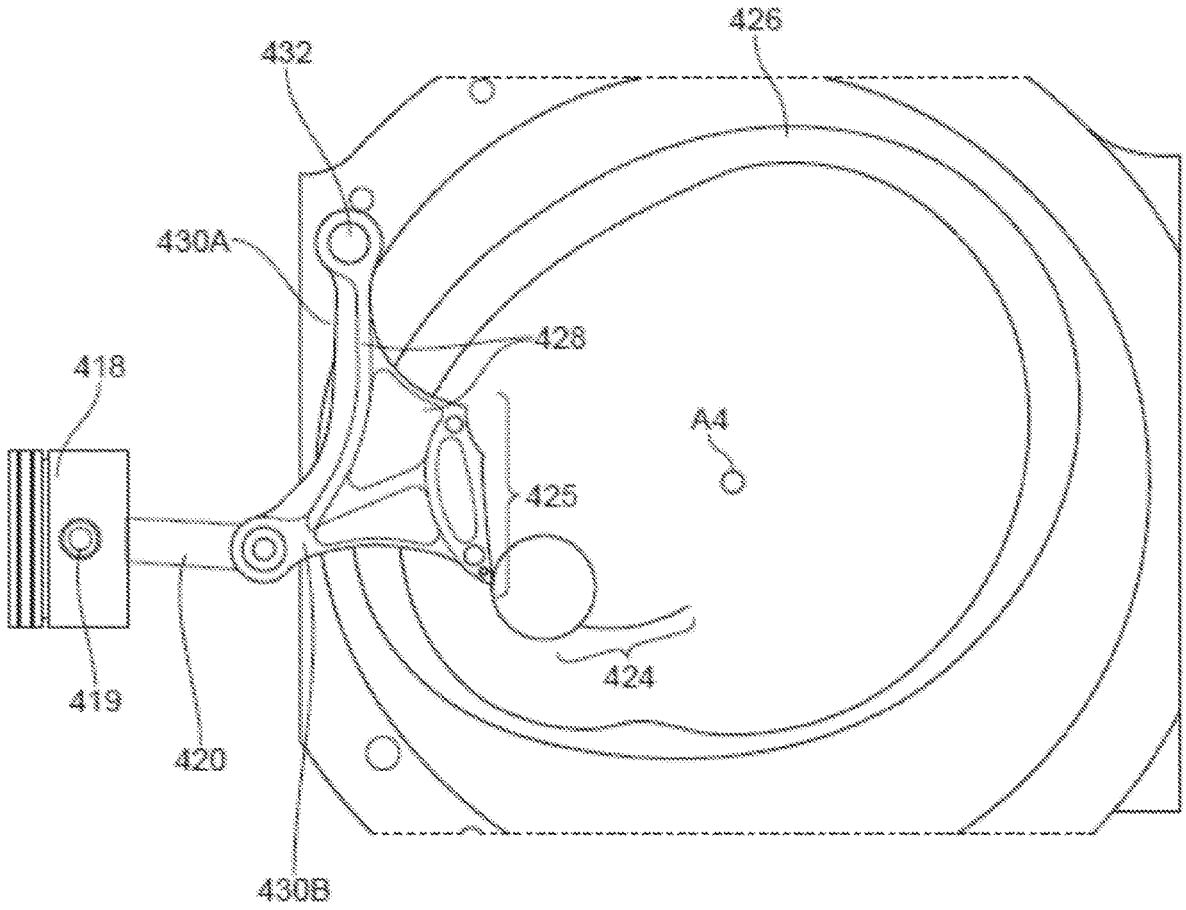
FIG. 6 shows a fourth piston arrangement.

In the arrangement shown in FIG. 6, the second connecting member 430 has been altered in shape so that it has a central block having the third engagement portion 425, which a first member 430*a* extending from the central portion to the pivot point 432 and a second member 430*b* extending from the central portion to the pin joint 421. It should also be noted that the followers 428 are disposed on the second member 430, as opposed to the first connecting member 420.

The first engagement portion 425 has been altered in shape so that it can fit with a second engagement portion 424, which is formed substantially as a cylindrical bearing.

The first engagement portion 425 may be formed as a roller and the second engagement portion 424 may be formed as a track.

In any of the above embodiments, the follower may be in the form of one or more rollers disposed on a pivot pin between the first and the second connecting members. The follower can be a single roller disposed between two tracks (i.e. a radially inner track and a radially outer track), or two rollers, one which engages a radially inner surface of the track and one which engages a radially outer track.

Figure 7:
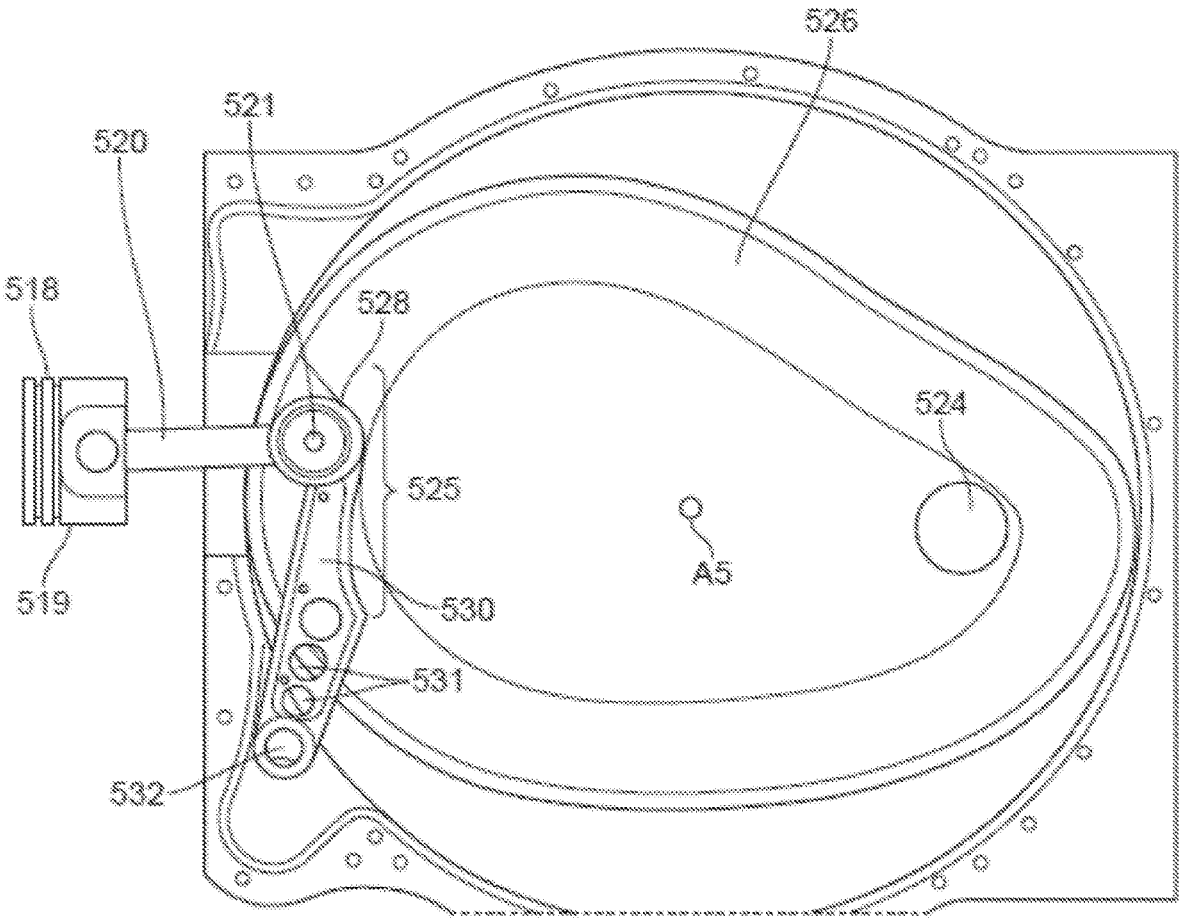
FIG. 7 shows a fifth piston arrangement.

For example, FIG. 7 shows a piston arrangement having a first connecting member 520 pivotably coupled to a second connecting member 530 at a pivot point 521 and a follower 528 arranged at the pivot point 521, the follower being arranged to follow a track 526. The follower 528 may be a wheel or roller mounted on a pivot pin which also extends through the first and second connecting members 520, 530.

The second connecting member 530 also has an engagement profile 525 for engaging an engagement profile 524, which is coupled in rotation to the track 526 to rotate about axis A5.

The second connecting member 530 is pivotable about a fixed pivot point 532 and may have a reduced weight due to holes 531.

Figure 8:
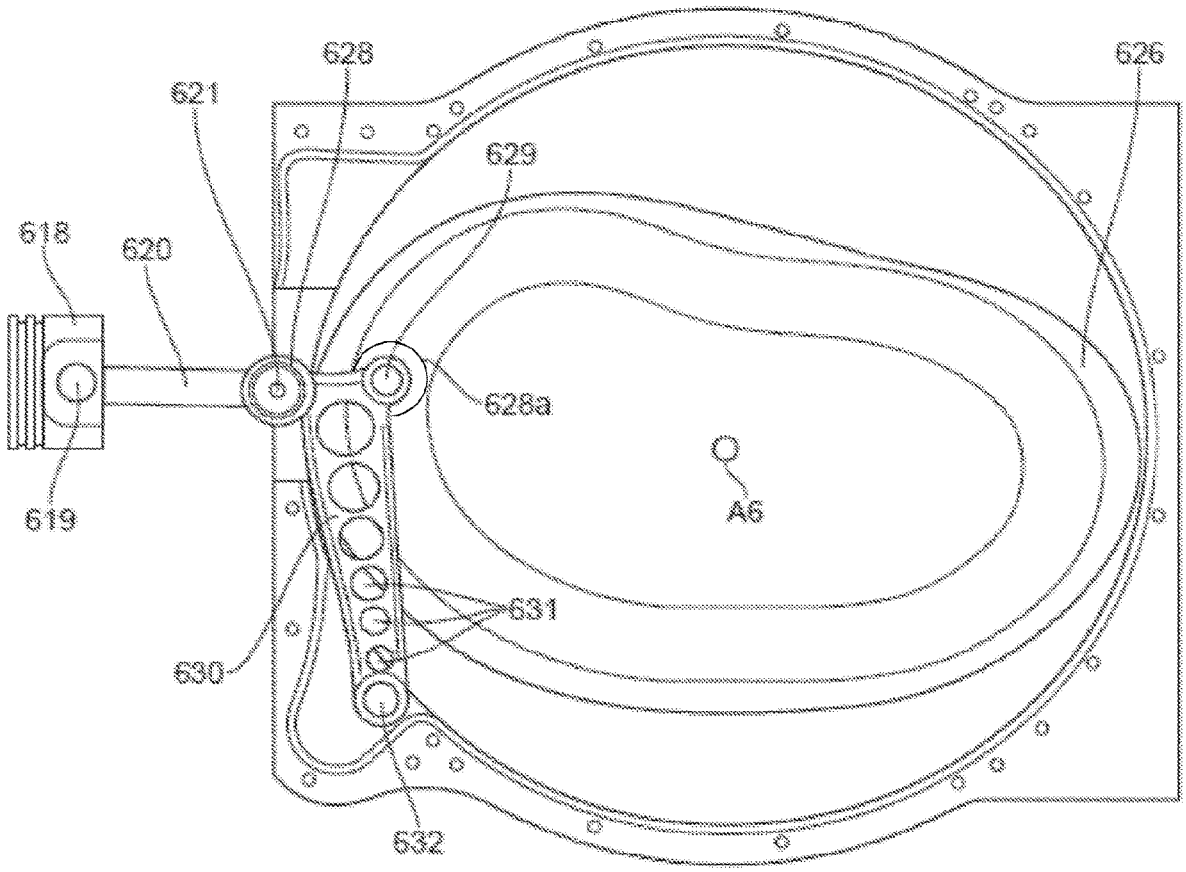
FIG. 8 shows a sixth piston arrangement.

FIG. 8 shows a piston arrangement having no engagement profile on the first or second connecting element or on the rotatable element. In the arrangement shown in FIG. 8, the force transfer between the rotatable element and the piston 618 is carried out via followers 628, 628*a* and the track 626.

A first follower 628 is arranged at the pivot joint 621 between the first connecting member 620 and the second connecting member 630 and a second follower 628*a* is arranged on the second connecting member 630, and mounter via a pivot pin 629 extending through the second member 630. Notably, the pivot pin 629 does not extend through the first connecting member 620.

The piston arrangement has a single track 626, which has the first and second followers 628, 628*a* disposed either side of it. Although the invention has been described above with reference to one or more preferred embodiments, it will be appreciated that various changes or modifications may be made without departing from the scope of the invention as defined in the appended claims.

The invention claimed is:

1. A piston arrangement comprising:

a piston;

a rotatable element, rotatable about an axis, having a first engagement profile; and a mechanism comprising:

a first connecting element connected to the piston;

a second connecting element pivotable about a fixed point and pivotally connected to the first connecting element; and a second engagement profile coupled to the first and/or second connecting element, configured to mechanically engage and disengage with the first engagement profile of the rotatable element, wherein the second engagement profile mechanically engages with the first engagement profile only on a drive stroke of the piston.

2. The piston arrangement of claim 1, wherein the second engagement profile includes a plurality of second teeth.

3. The piston arrangement of claim 2, wherein at least two of the second teeth have different sizes.

4. The piston arrangement of claim 1, wherein the plurality of second teeth are arranged as a rack.

5. The piston arrangement of claim 1, wherein the first engagement profile includes a plurality of first teeth.

6. The piston arrangement of claim 1, wherein the rotatable element is a sector gear.

7. The piston arrangement of claim 1, wherein the first and the second engagement profiles engage at a point between the fixed point and the axis.

8. The piston arrangement of claim 1, wherein when the first and the second engagement profiles engage, the second connecting member rotates in a first angular direction about the fixed point and the rotatable element rotates in a second angular direction about the axis, the first angular direction being opposite to the second angular direction.

9. The piston arrangement of claim 1, further comprising a track arranged to rotate about a track axis, the piston being coupled to the track, wherein the track and the rotatable element are coupled in rotation.

10. The piston arrangement of claim 9, wherein the piston is coupled to the track via a follower coupled to the first and/or second connecting element, the follower being arranged to run along a surface of the track.

11. The piston arrangement of claim 10, wherein the follower is coupled to the first and second connecting elements at the pivotal connection between the first and second connecting elements.

12. The piston arrangement of claim 9, wherein the track is shaped such that the movement of the piston coupled to the track is substantially non simple harmonic.

13. The piston arrangement of claim 1, wherein the piston reciprocates twice for each rotation of the rotatable element.

14. The piston arrangement of claim 1, wherein the piston is a first piston, the piston arrangement further comprising a second piston, a further first connecting element connected to the second piston, and a further second connecting element pivotable about a second fixed point and pivotally connected to the further first connecting element, wherein the rotatable element is configured to mechanically engage and disengage with each of the first connecting elements.

15. The piston arrangement of claim 14, wherein the second piston and the first piston are arranged in an opposing relationship.

16. An internal combustion engine comprising a piston arrangement according to claim 1.

17. A piston arrangement comprising:

a piston;

a rotatable element comprising a track, rotatable about an axis, a mechanism comprising:

a first connecting element connected to the piston;

a second connecting element pivotable about a fixed point and pivotally connected to the first connecting element; and a first follower arranged to follow the track, the follower coupled to the second connecting element.

18. The piston arrangement of claim 17, wherein the first follower follows the track by engaging a radially inner surface of the track, and wherein the piston arrangement further comprises a second follower coupled to the first and/or second connecting element, which follows the track on a radially outer surface of the track.

19. The piston arrangement of claim 18, wherein the second follower is coupled to the first and second connecting elements at the pivotal connection between the first and second connecting elements.

20. A piston arrangement comprising:

a piston;

a rotatable element comprising a track, rotatable about an axis; and a mechanism comprising:

a first connecting element connected to the piston;

a second connecting element pivotable about a fixed point and pivotally connected to the first connecting element;

a first follower arranged to follow the track by engaging a radially inner surface of the track, the first follower coupled to the second connecting element; and a second follower arranged to follow the track on a radially outer surface of the track, the second follower coupled to the first and/or second connecting element.

* * * * *